United States Patent [19]

Herman

[11] Patent Number: 4,623,149

[45] Date of Patent: Nov. 18, 1986

[54] BOWLING BALL FINGER INSERT

[76] Inventor: Joseph Herman, 109 Timberland Dr., Elyria, Ohio 44035

[21] Appl. No.: 730,166

[22] Filed: May 3, 1985

[51] Int. Cl.[4] ..... A63B 37/00

[52] U.S. Cl. ..... 273/63 A

[58] Field of Search ..... 273/63 A, 63 R, 63 B, 273/63 C, 63 D, 63 E, 63 F, 63 G, 65 EG

[56] References Cited

U.S. PATENT DOCUMENTS

| | | | |
|---|---|---|---|
| 447,011 | 2/1891 | Harman | 273/63 A |
| 626,584 | 6/1899 | Wilmerling | 273/63 A |
| 950,838 | 1/1910 | Cavanagh | 273/63 A |
| 4,289,312 | 9/1981 | Heimbigner | 273/63 A |
| 4,432,546 | 2/1984 | Allen | 273/63 A |
| 4,569,520 | 2/1986 | Yamane | 273/63 A |

*Primary Examiner*—George J. Marlo
*Attorney, Agent, or Firm*—Gustalo Nunez

[57] ABSTRACT

A longitudinal live rubber bowling ball insert having the purpose of providing a finger hole which is of a size which more properly matches the finger size of the user and, in which an internal wall portion of the insert is provided with a plurality of grooves, said grooves greatly increasing the "lift" which may be applied to the ball by the user resulting with the bowling ball having a more pronounced hook as it travels down the bowling alley. The insert is angled on both opposing ends, thus enabling the insert to be used in bowling balls drilled for right-handed or left-handed bowlers. The terminating angle is necessary in order that the insert, once placed in the bowling ball, does not extend out beyond the ball surface.

1 Claim, 7 Drawing Figures

BOWLING BALL FINGER INSERT

BACKGROUND OF THE INVENTION

The instant invention is directed to an elongated tubular insert which is inserted into a bowling ball finger hole wherein said insert defines a finger hole which is more closely in size to that of the user's finger and which has the feature of permitting the user to provide more lift to the bowling ball when in actual use. The more lift that one puts on a bowling ball, the more hook one gets; the more hook one gets, the more pin action.

A novelty search was not conducted in this particular instance, however, the applicant is aware of U.S. Pat. No. 4,289,312. This patent is directed to a resilient bowling ball insert with a segment thereof having increased wall thickness which serves to cushion the user's finger.

The applicant's co-pending application Ser. No. 648,253 also is directed to an improved bowling ball insert, in some respects, similar to the insert described herein, and quite dissimilar in other respects. The insert described in application Ser. No. 648,253 requires that one maintain an inventory for both left and right-handed bowlers. The instant invention can be used by both right-handed and left-handed bowlers simply by reversing the insert when placing it in the ball finger hole, thereby requiring an inventory of only one type of bowling ball finger insert.

SUMMARY OF THE PRESENT INVENTION

The present invention is directed to a bowling ball finger hole insert which is economical to manufacture and which is simple in construction. The finger insert is an elongated cylindrical tube which may or may not have extending shoulders on the outside wall surface. In the event the finger is manufactured with extending shoulders, it can only be used with a bowling ball having finger holes equipped with recesses which are complementry to the outwardly extending shoulders. The finger inserts are inserted into the bowling ball finger hole to a depth determined when the outside extending shoulders fall into the complementry recesses located in the bowling ball finger hole, as mentioned above.

Those finger hole inserts manufactured without outside extending shoulders may be inserted into the bowling ball finger hole and held in place by the use of conventional glues or double-faced tapes.

Located within the finger hole insert is a wall surface which is not smooth. It may be a surface made of grooves, it may be a surface of intersecting parallel grooves or it may be a surface having a plurality of dimples thereon.

The insert described herein is open at both ends. Also, the opposing terminating edges are angled in opposite directions. The axis of a finger hole for a left-hander is opposite that for a right-hander, hence, the insert described here can be used in holes drilled for left and right-handed bowlers simply by reversing the insert prior to insertion in the bowling ball insert. The angled edge permits the insert to be flush with the outside ball surface without the necessity of performing any finishing work.

In bowling, it is the object of the bowler to knock down as many pins as he can. Most successful bowlers would like to throw a ball which has a substantial hook because this kind of ball historically gets the most pin action which means higher scores. To make a ball hook, it is necessary to impart lift to the ball upon releasing it.

This is done by withdrawing the thumb from the thumb hole and throwing the ball down the alley using the two fingers to give the ball the necessary lift. The applicant's invention facilitates this process. In use, the bowler's fingertips press on the grooved wall surface which means more friction between the fingers and the finger insert wall surface which results in increased lift when the bowling ball is released.

The insert is preferably manufactured out of a highly resilient material such as a live rubber material.

DETAILED DESCRIPTION OF THE PREFERRED EMBODIMENT

Figure 1:
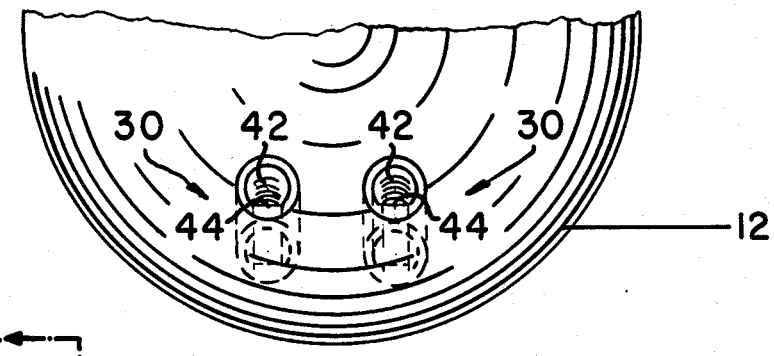
FIG. 1 is a plan view of a bowling ball provided with a pair of the present inserts.
Figure 2:
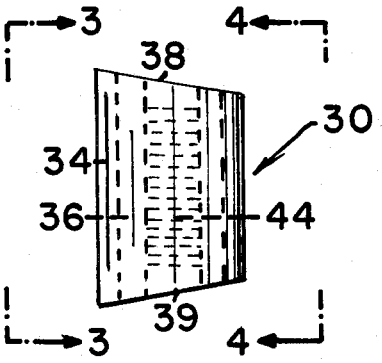
FIG. 2 is a side view of the insert, partially cross-sectional.
Figure 3:
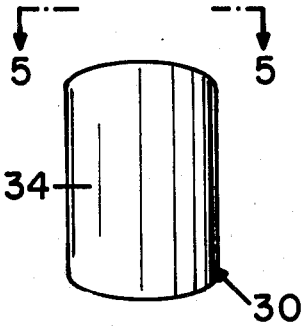
FIG. 3. is a side view of the insert taken along lines 3—3 of FIG. 2.
Figure 4:
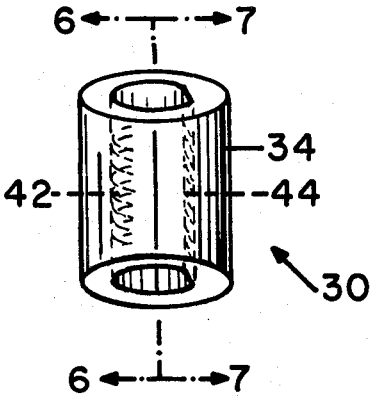
FIG. 4 is a side view of the insert taken along lines 4—4 of FIG. 2.

Referring to the drawings, the reference numeral 30 indicates generally the bowling ball finger insert and in FIG. 1, the bowling ball finger insert 30 is shown inserted in a bowling ball 12. The finger insert 30 is an elongated circular tube having an outside wall surface 34 and an inside wall surface 36. The finger insert 30 may be made from any resilient material, and in the instant invention the inventor has found that silicone rubber is a desirable material to use. At one terminating edge 38 of the finger insert 30, it can be seen that the edge 38 is manufactured having a slope. Terminating edge 38 also defines a finger opening. At the other terminating edge of the insert 30, there is described an edge 39 which is also sloped at an angle opposing the slope of the edge 38. The edge 39, like the edge 38, also defines a finger opening. The slope defined by edges 38 and 39 is such that when inserted in a bowling ball finger hole, the terminating edge will be flush with the outside ball surface. The edge 38 or 39 which will be flush with the outside ball surface, is determined by whether the ball is drilled for a left-handed or right-handed bowler. The highest part of the tapered edge, either 38 or 39, is inserted such that it is facing the high part of the ball. In other words, the slope, defined by each of the terminating ends 38 and 39, corresponds to the curvature of a spherical bowling ball.

Figure 5:
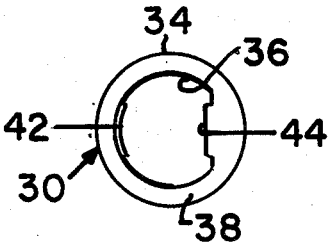
FIG. 5 is a top plan view of an insert taken along lines 5—5 of FIG. 3.
Figure 6:
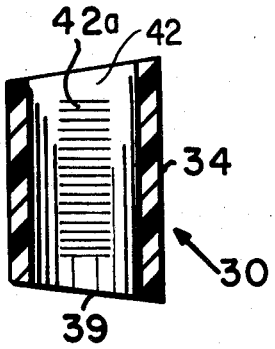
FIG. 6 is an inside cross-sectional side view of the insert taken along lines 6—6 of FIG. 4.
Figure 7:
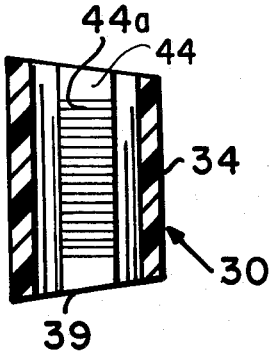
FIG. 7 is an inside cross-sectional side view of the insert taken along lines 7—7 of FIG. 4.

Referring now to FIGS. 5, 6 and 7, there is described the inside surfaces of the insert 30. Inside wall surface 42 is described as a longitudinal wall surface, parallel to the axis of the finger insert 30, said wall surface 42 having a plurality of grooves **42*a*, however, said grooves 42*a* may be omitted if desired, inscribed thereon. Opposing inside wall surface 42 is a wall surface 44, longitudinal in description and parallel to the axis of the finger insert 30. Said inside wall surface 44 in the preferred embodiment is provided with a plurality of grooves 44*a*, said grooves 44*a* being perpendicular to the axis of said tubular body 30 and said grooves 44*a* located on a generally planar surface located generally parallel to a plane passing through the highest and lowest points of said sloped ends, and said wall surface 44 being provided with more material such that the wall surface is thicker in dimension than other portions of the wall surface such as described in FIG. 5**.

In use, the insert 30 would be inserted in the bowling ball finger hole such that the wall surface 44 would be in contact with the user's finger tips. The edge, 38 or 39, which is inserted first, would be determined by whether the user is a left-handed or right-handed bowler. The sloped terminating edge 38 or 39 would then necessarily be flush with the bowling ball surface. Because the gripping surface on the bowling ball finger inserts 30 are formed oppositely for left-handed and right-handed bowlers, the insert 30 can be used by either simply by reversing the direction of insertion.

The majority of bowlers throw a hook because this provides increased pin action which results in higher scores. The hook enables the ball to strike the pin rack at an angle which geometrically also provides more pin action and, therefore, higher scores. The grooves 44*a* are placed such when the bowler's fingers are in the ball's hole, the bowler's fingers are in pressure contact with the grooves 44*a*. When the ball is thrown, there is increased friction between the bowler's fingers and the grooves 44*a* which in combination provide increased lift thus allowing the bowler to throw a more pronounced hook. Further, the combination of the wall surfaces 42 and 44 provide a closer finger fit with respect to the user's finger, a vacuum is created between the finger and the insert which also results in additional lift being applied to the bowling ball when released.

While I have shown but two embodiments of the invention, it will be apparent to those skilled in the art that the invention may be embodied still otherwise without departing from the spirit and scope of the invention.

Having thus described the invention, what is claimed and desired to be secured under a Letters Patent is:

1. A finger grip insert for bowling balls, said insert comprising:

an elongated tubular resilient body having an outside wall surface and an inside wall surface, and first and second terminating ends, said resilient body being open at both ends, said terminating ends having a preselected slope relative to the axis of said elongated tubular body, said slope corresponding to the curvature of a spherical bowling ball, said elongated tubular resilient body including first and second inside wall surfaces, said second wall surface having a plurality of grooves inscribed thereon, said grooves being perpendicular to the axis of said tubular body, said grooves located on a generally planar surface located generally parallel to a plane passing through the highest and lowest points of said sloped ends, the wall forming said second wall surface being of a greater thickness than the wall forming said first wall surface, and said tubular resilient body being inserted in a bowling ball finger hole such that when said first terminating end is inserted first in a bowling ball for a left handed bowler, said grooves will be in contact with the finger tips of said left-handed bowler; and when said second terminating end is inserted in a bowling ball for a right-handed bowler, said grooves will be in contact with the finger tips of said right-handed bowler, said second wall surface providing a smaller opening within said elongated tubular body thereby providing greater friction to the finger of a user, and in both placements, the terminating end of said elongated tubular body, because of its sloped end, will be flush with the outside surface of said bowling ball.

* * * * *